United States Patent [19]

Lansberry

[11] 4,032,149

[45] June 28, 1977

[54] TARGET GAME FOR ROLLING MISSILE

[76] Inventor: Delbert B. Lansberry, 211 S. Trask St., Hillsbourgh, Fla. 33609

[22] Filed: Oct. 10, 1975

[21] Appl. No.: 621,377

[52] U.S. Cl. ..... 273/123 R; 273/127 B

[51] Int. Cl.[2] ..... A63F 7/00

[58] Field of Search ..... 273/95 R, 101, 102 R, 273/102 S, 105 R, 105 A, 118 R, 123 R, 127 R, 127 B, 177 R, 177 A, 181 R, 119 R

[56] References Cited

UNITED STATES PATENTS

| | | | |
|---|---|---|---|
| 1,072,954 | 9/1913 | Junn | 273/105 R |
| 1,622,877 | 3/1927 | McMann | 273/119 R |
| 1,662,864 | 3/1928 | Petersen | 273/119 R |
| 2,029,107 | 1/1936 | Klein | 273/105 R X |
| 2,145,840 | 1/1939 | Thompson et al. | 273/105 A X |
| 2,220,492 | 11/1940 | Piesco | 273/105 R X |
| 3,065,968 | 11/1962 | Gelencser | 273/127 R X |
| 3,785,656 | 1/1974 | Gybowski | 273/177 A |
| 3,822,063 | 7/1974 | Rea | 273/105 R |

*Primary Examiner*—Richard J. Apley
*Attorney, Agent, or Firm*—T. D. Lindgren

[57] ABSTRACT

This invention relates to a target game wherein a ball or similar missile is tossed and rolled, in a bowling manner, over a horizontal surface toward a target member. The target consists of partially enclosing side frames, a rear gate assembly, a top webbing and a scoring grid to provide a plurality of internal scoring sectors, each sector being defined by base ribs. Each scoring sector may be identified by a number or a color. The target may be collapsible or foldable for storage and transport. Provisions for keeping score and for bonus scoring are included. The game, in its mode of play, may be related to space travel, baseball, jackpot, bowling, lunar ball, or black jack by the designation of apparatus with appropriate names for targets and scoring sectors. Scoring may be measured in terms of the various space-related or conventional point units, depending upon the type of game chosen for playing.

4 Claims, 7 Drawing Figures

TARGET GAME FOR ROLLING MISSILE

BACKGROUND OF THE INVENTION

1. Field of the invention

This invention relates to an improved indoor-outdoor game and more particularly to a lawn game in which two, three or more players roll is missile toward a target.

2. Brief Description of the Prior Art

There are numerous target-type games in the field of art. These include games having a bulls-eye target at which an object is thrown as well as games having a face with apertures through which a ball or missile is thrown. Few such target games utilize the concept of a ball or missile which is to be tossed or rolled along a generally horizontal surface in a bowling-type fashion. In bowling-type games, the object is usually to strike pins or other elements with the ball or missile, rather than to cause the ball or missile to come to rest at a particular point or area.

Bowling-type games are generally popular, are playable by people of greatly varying ages and are easily understood and executed. There is a definite need for new forms of a game utilizing the concept of a thrown or rolled ball or missile. In addition, target-type games are similarly easily understood and well-received. The purpose of this invention is to meet the continuing need for improvement in games using the concept of a thrown ball or missile and a fixed target.

SUMMARY OF THE INVENTION

It is, therefore, the main purpose of this invention to provide an indoor or outdoor lawn-type game which will significantly contribute to the physical well-being of the players.

The invention relates to an improved target game wherein many different types of games may be played by tossing or rolling a ball or similar missile toward a target member.

The invention also relates to a rigid target element, foldable for storage and transport purposes, which is constructed and arranged for use on a generally horizontal supporting surface.

The target element consists of a plurality of scoring sectors what may be in the shape of a square, trapezoid, triangle, circle or combination thereof. Each sector is formed from a grid of base ribs which may be integrally formed with the target element. The horizontal side anchor bars position the side frames in a substantially parallel relation to each other. The rear of the target element is provided with a folding tail gate which serves as the ball or missle stop. This member also functions as a brace and as a ball carrier. Two or more balls or similar type missiles are used by the players in attempts to toss and roll the balls over the base ribs of the scoring grid of the target and into one of the plurality of scoring sectors.

The scoring grid may be provided with special sectors which could result in bonus points for the players whose balls come to rest therein, such as three certain sectors in a row, or sectors having specified numerical values, or sectors all of one color, etc.

The target is designed to collapse or fold into a compact volume for ease in storing and transporting. When collapsed or folded, the target forms a container for carrying and storing the balls and a collapsible score card, rod and holder.

The target is merely laid on the ground or other horizontal surface and therefore may be easily moved from one location to another during use. The game may be played inside or outside on lawns or any other substantially flat surface. The surface requires no special preparation.

Several different games may be played using the same target and rolling missiles of this invention, depending on the rules adopted by the players. For example, the various scoring sectors of the scoring grid of the target may be designated with lunar and other space-related names and scoring based on lunar and other space-related measurements. To illustrate the foregoing, the target may be referred to as a space station, the scoring sectors may be named after planets and scoring points may be expressed in lunar miles.

As another example, a type of baseball game may be played with the designated points of each sector referred to as runs, etc., or a jackpot-type game may be played, with the designated points referred to as dollars or pennies, etc.

When more than one target is used by the players, the targets may be tied or otherwise attached to each other for purposes of carrying or storage.

DETAILED DESCRIPTION OF THE INVENTION

Figure 1:
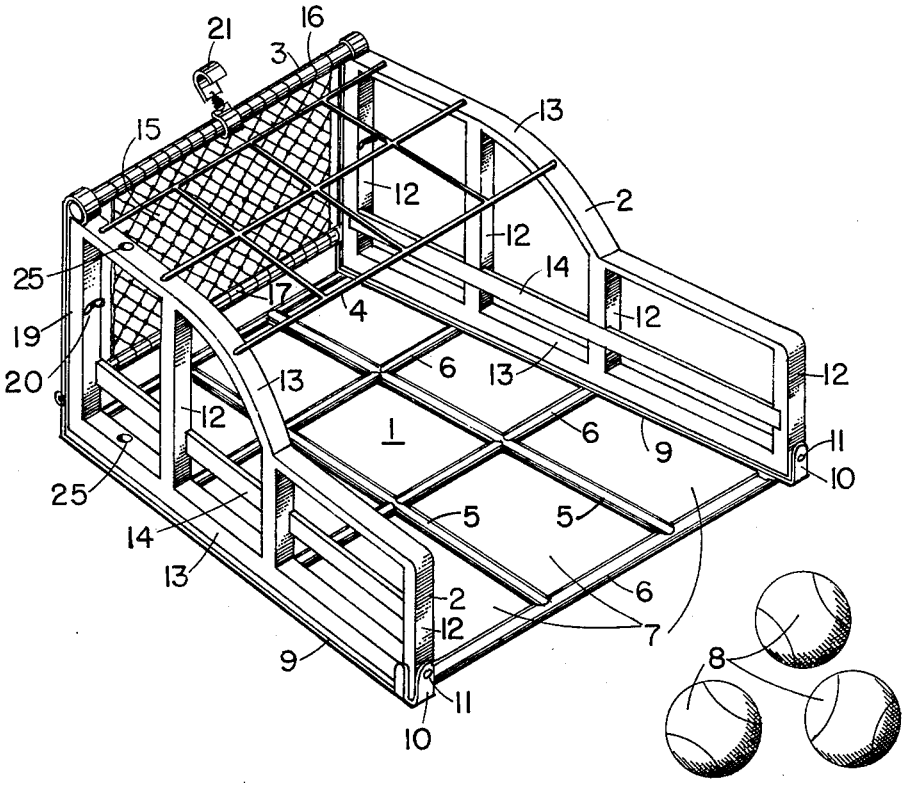
FIG. 1 is a perspective view of the collapsible embodiment of the target apparatus and missiles of this invention.

Referring to FIG. 1 there is shown a perspective view of the game apparatus of this invention. The partially enclosed collapsible target element is comprised of a scoring grid 1, side frame members 2, rear gate assembly 3, and optional top web 4. The scoring grid 1 is defined by a multiplicity of longitudinal ribs 5 and latitudinal ribs 6 arranged to form a plurality of scoring sectors 7 at which rolling missile 8 is aimed by the players. Top web 4 is comprised of cord-like elements attached to one another and attached to the rear of side frame members 2 to form a barrier to aid in preventing the rolling ball or missile from escaping from the target element.

Figure 2:
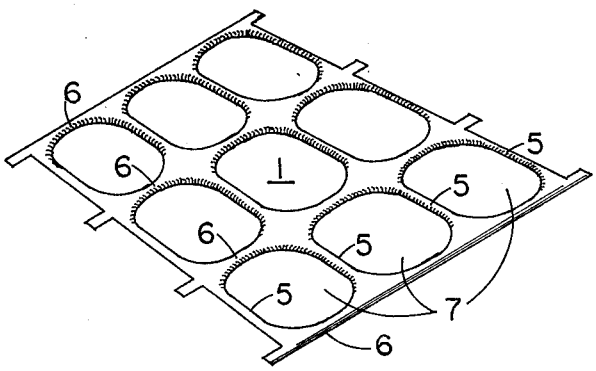
FIG. 2 is a perspective view of an alternative embodiment of the scoring sectors.

Rib members 5 and 6 are secured together in any suitable manner, such as welding, or may be integrally formed as a unit out of any suitable material such as wood, plastic, rubber or metal. FIG. 2 shows an alternate scoring grid wherein the scoring sectors are one of a variety of many possible shapes.

Horizontal anchor bars 9 are secured to the ends of the latitudinal ribs 6 by any suitable method, such as welding, riveting, bolting or said horizontal anchor bars 9 may be integrally formed with scoring grid 1. Each horizontal anchor bar 9 is designed to hinge, secure, and support a side frame member 2 in a vertical upright position during play and a horizontal position for storage or transport. The pivoting or hinging is accomplished by forming pivot bars 10 which are affixed to and extend upward from the end of each horizontal anchor bar 9. Side frame members 2 are pivotally attached by inserting pivot pins 11 thorugh holes in said pivot bars 10.

Side frame members 2 may be assembled from separate vertical posts 12, upper and lower beams 13 and horizontal bumper bars 14 or may be integrally formed as a unit out of any suitable material such as wood, plastic or aluminum. The side frame members 2 assist in retaining the missiles 8 on a more even course and aide in keeping missiles 8 within the target area.

Figure 3:
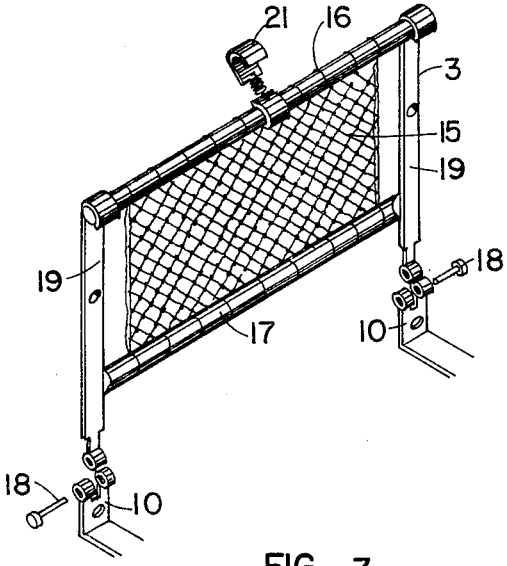
FIG. 3 is a view of the rear gate assembly of the game apparatus of FIG. 1.

FIG. 3 shows the rear gate assembly 3 which is made of a net-like material 15 which aids in keeping missiles 8 within the target area and may be constructed of any flexible or elastic material such as rubber, plastic, cord or clain. The netting may be attached to the gate assembly 3 by looping it over and around the upper gate bar 16 and lower gate bar 17 and securing by screws or other suitable means. The lower gate bar 17 also serves as an additional missile stop or bumper. A double thickness of net-like material 15, open at one end, may be caused for storage of missiles 8 when the game is not in use. The rear gate assembly 3 is attached to the target element by means of hinge pins 18 inserted through pivot bars 10 and gate posts 19, and may be bolded into an upright position during play by means of bolts and wing nuts 20 or any other suitable means. Rear gate assembly 3 may be secured in its folded or collapsed position by a spring and hook 21 which attaches to an adjacent latitudinal rib 6. The rear gate assembly 3 may be integrally formed as a unit out of any suitable material such as plastic or aluminum.

Figure 4:
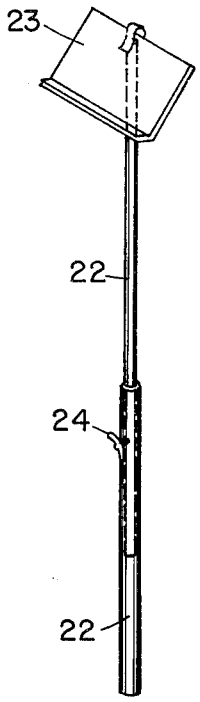
FIG. 4 indicates an adjustable score card, rod and holder for use with the game.

Referring to FIG. 4 there is shown an adjustable or telescoping score card rod 22 and holder 23. Adjustment is made to the score card rod 22 by means of a locking screw 24. Rod 22 may be inserted in holes 25 in upper and lower beams 13 during use. Alternatively, rod 22 may be inserted in the ground. For storage or transport the score card rod 22 is closed to its smallest position and placed within the target apparatus before folding game 8.

Figure 5:
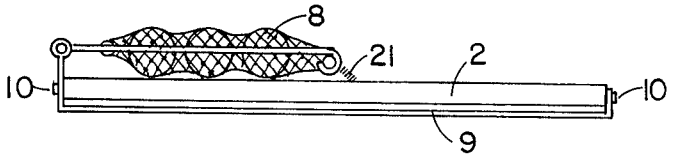
FIG. 5 is a side view of the game apparatus of the invention in its collapsed state.
Figure 6:
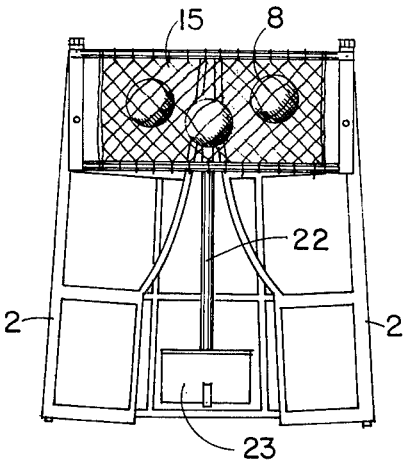
FIG. 6 is a top view of the game apparatus in its collapsed state showing the missiles, score card, rod and holder placed within same for transporting or storage.
Figure 7:
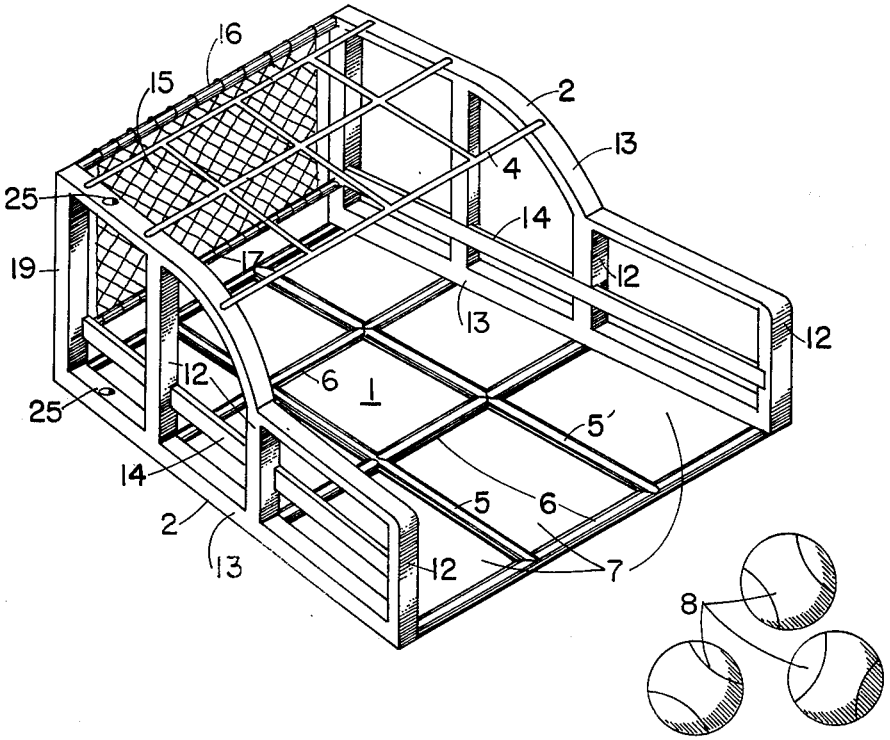
FIG. 7 is a perspective view of a non-folding embodiment of the target apparatus and missiles of this invention.

FIGS. 5 and 6 illustrate the collapsed configuration of the target. FIG. 7 illustrates a non-collapsible target of this invention, and embodies all the novelty of this invention except that the target element is made as one integral unit. This unit may be formed out of any suitable material such as plastic or aluminum.

OPERATION

The game is played by placing one or two targets on a lawn or other reasonably flat surface. Two or more players may complete against each other. As in other games, an even number of players may be divided into teams. Each player is given three balls and each ball is tossed and rolled toward the target from a distance of 10 to 20 feet, depending upon the age and skill of the player. The highest scoring sectors are the sectors of the target nearest the player, and therefore the player attempts to cause the ball to come to rest in those sectors. For example, a ball at rest in the nearest sectors may result in a score of three points, the next sectors two points, the next sectors one point. In one version of the game, the players may alternate turns and attempt to knock the balls of previous players into lower scoring sectors. Where many players are playing, the balls may be removed after each player has rolled three consecutive balls, depending on the type of game being played.

In the course of playing any one of the games provided for on the target, special bonus points may be awared to the player whose three balls come to rest in designated scoring sectors. As an example, three balls that come to rest in a horizontal row, or a vertical row, or three scoring sections of the same color, would lead to designated bonus points.

Obviously, the game of the invention may take several forms or combinations of forms. For example, the target may be referred to as a lunar space station and sectors may be named after planets and scores measured in millions of miles. Another possible version involves use of baseball nomenclature, where scores might be measured in runs.

While the invention has been described in connection with different embodiments thereof, it is understood that it is capable of further modification, and this specification is intended to cover any variation of the invention as might come within known or customary practice in the art to which the invention pertains.

What I claim is:

1. In combination, a target game comprising missiles and a partially enclosed target element; said target element having netted rear gate means; upstanding side frame members, each defined by a plurality of vertical posts connected by upper and lower beams and an intermediate bumper bar; a horizontally disposed scoring grid defined by a plurality of longitudinal and latitudinal ribs arranged to form open scoring sectors and integrally affixed to said side frame members; and a top web member attached to a portion of said side frame members, whereby said target element has a forward unobstructed portion for receiving said missiles when launched by a player.

2. The combination of claim 1 in which said netted rear gate means contains a storage pocket formed by two thicknesses of netted material.

3. The combination of claim 1 with adjustable-height score holder comprised of a holder attached to an adjustablelength rod with set screw, one of said side members provided with holes in upper and lower beams for insertion of said rod.

4. The combination of claim 1 wherein said horizontally disposed scoring grid is comprised of sectors orbicular in shape.

* * * * *